US006076263A

United States Patent [19]

Andis et al.

[11] Patent Number: 6,076,263

[45] Date of Patent: Jun. 20, 2000

[54] HAIR CLIPPER WITH RESILIENTLY REMOVABLE COVER PORTION ENCLOSING A BLADE DRIVE ASSEMBLY

[75] Inventors: Mathew L. Andis, Racine; John M. Piwaron, Milwaukee, both of Wis.

[73] Assignee: Andis Company, Racine, Wis.

[21] Appl. No.: 08/895,803

[22] Filed: Jul. 17, 1997

[51] Int. Cl.[7] ..... B26B 19/02

[52] U.S. Cl. ..... 30/216; 30/210

[58] Field of Search ..... 30/210, 216, 215, 30/217, 218, 219, 220

[56] References Cited

U.S. PATENT DOCUMENTS

| | | | |
|---|---|---|---|
| 1,839,924 | 1/1932 | Lutes | 30/216 |
| 2,650,993 | 9/1953 | Brown et al. | 30/216 |
| 2,726,447 | 12/1955 | Maloy | 30/216 |
| 3,119,942 | 1/1964 | Luther | 30/216 |
| 3,520,059 | 7/1970 | Gringer . | |
| 4,266,341 | 5/1981 | Claassens | 30/210 |
| 5,088,200 | 2/1992 | Piwaron et al. | 30/216 |
| 5,207,731 | 5/1993 | Bukoschek | 30/43.7 |
| 5,212,899 | 5/1993 | Fandreyer . | |
| 5,230,153 | 7/1993 | Andis | 30/216 |
| 5,544,415 | 8/1996 | Huang | 30/210 |

OTHER PUBLICATIONS

Hot Pot—model BC–1762, by Betty Crocker, prior to Jul. 1996.

*Primary Examiner*—Hwei-Slu Payer
*Attorney, Agent, or Firm*—Michael Best & Friedrich LLP

[57] ABSTRACT

Disclosed herein is a hair clipper comprising a blade set, a blade drive assembly located in rearward relation to the blade set and drivingly connected to the blade set, a housing assembly extending rearwardly from the blade set and including a main portion, and a removable portion located adjacent the blade set in enclosing relation to the blade drive assembly, and structure on the main portion and on the removable portion resiliently and removably connecting the removable portion to the main portion.

18 Claims, 2 Drawing Sheets

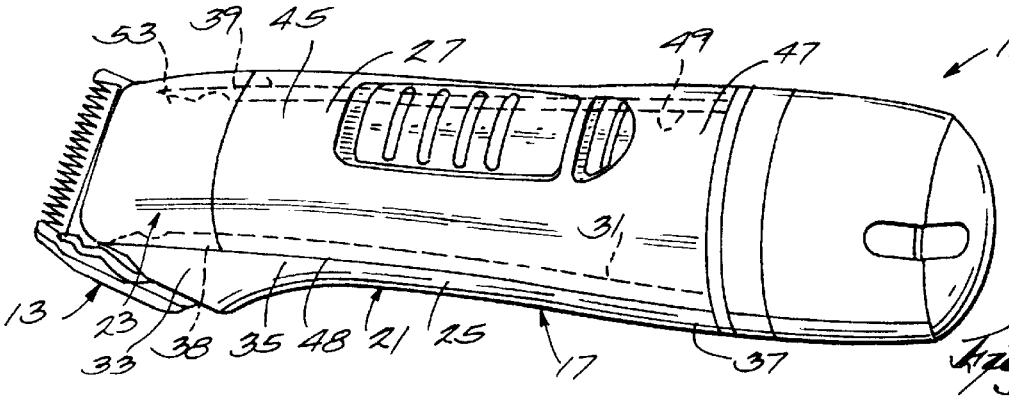
Fig. 1
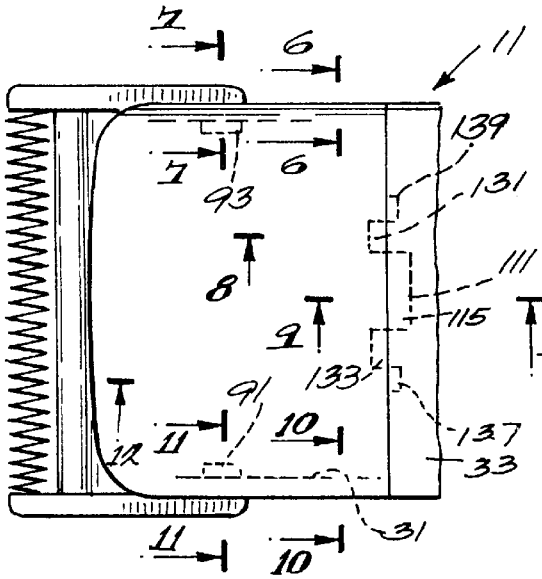
Fig. 2.
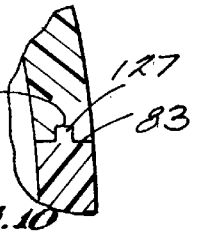
Fig. 10
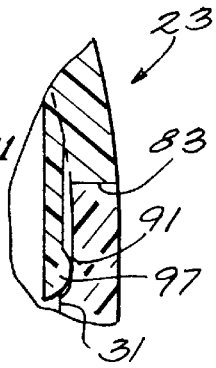
Fig. 11
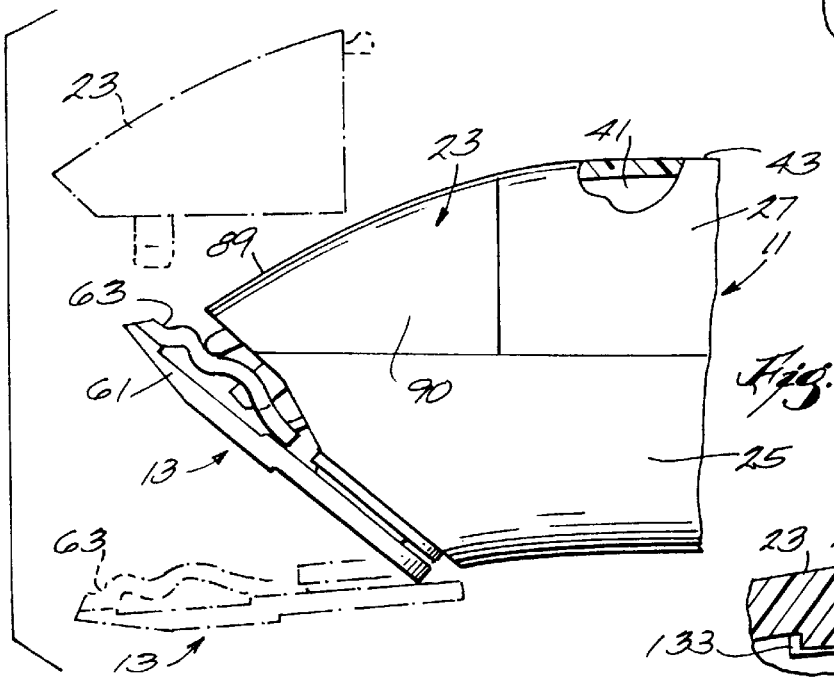
Fig. 3
Fig. 12
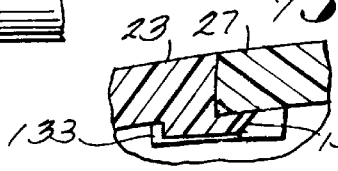

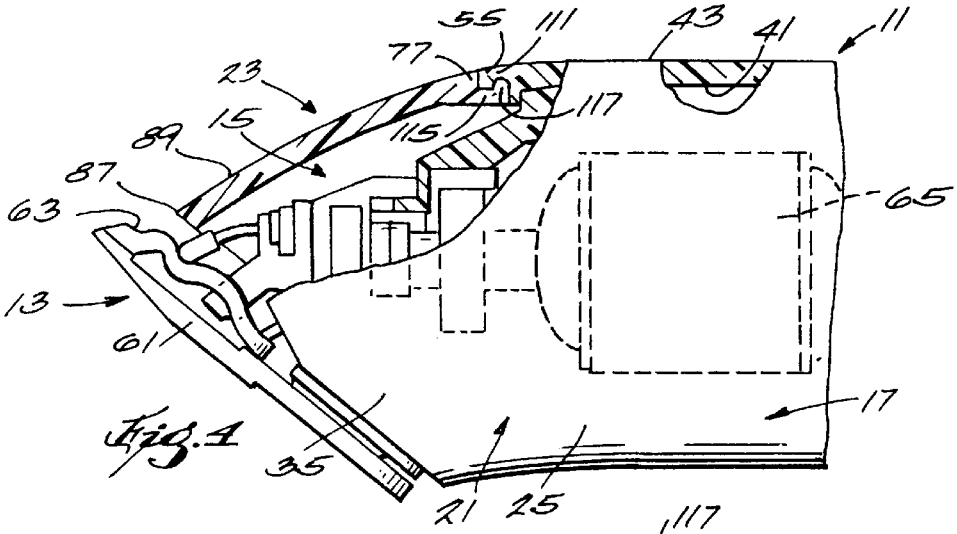
Fig. 4
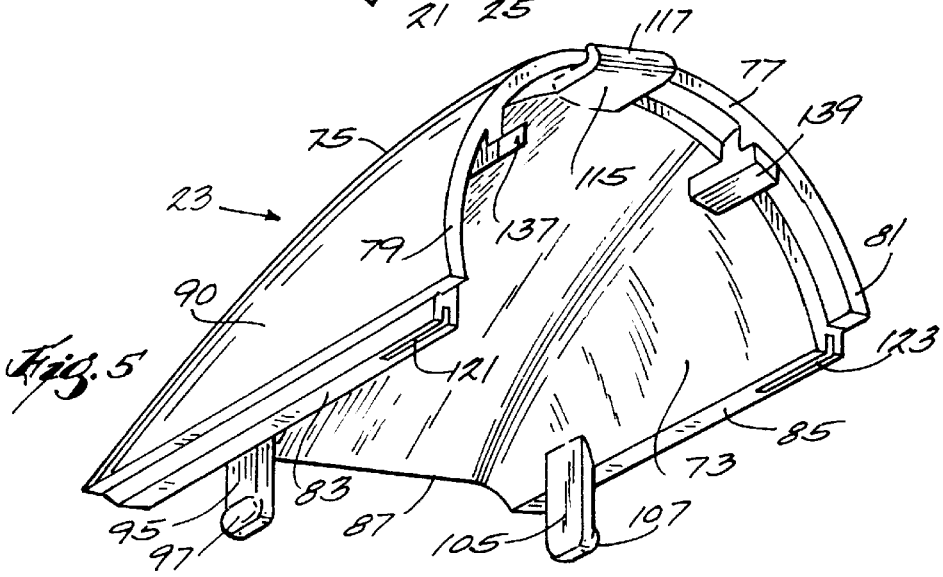
Fig. 5
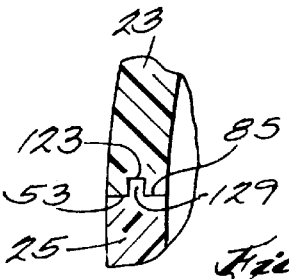
Fig. 6
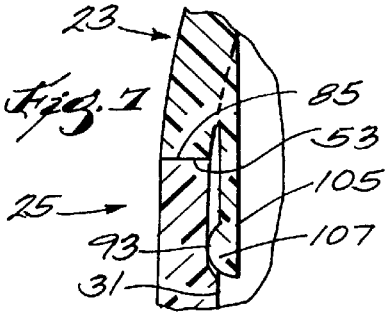
Fig. 7
Fig. 8
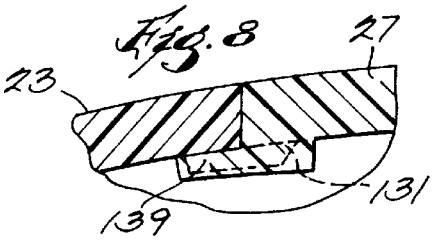
Fig. 9
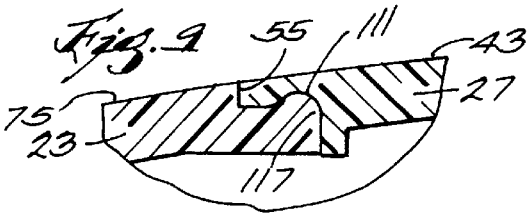

HAIR CLIPPER WITH RESILIENTLY REMOVABLE COVER PORTION ENCLOSING A BLADE DRIVE ASSEMBLY

BACKGROUND OF THE INVENTION

The invention relates generally to hair clippers, and more specifically, to hair clippers which include an electrically operated motor enclosed within an outer housing assembly and which reciprocates a cutter blade of a cutting blade set through a blade drive assembly.

In the past, some hair clippers included a removable cover or portion which covered the forward portion of the blade drive mechanism and which was connected to the remainder of the hair clipper by screws requiring the use of a screw driver to obtain removal of the cover from the hair clipper.

Attention is directed to U.S. Pat. No. 5,088,200, issued Feb. 18, 1992 and incorporated herein by reference.

SUMMARY OF THE INVENTION

The invention provides a hair clipper comprising a blade set, a blade drive assembly located in rearward relation to the blade set and drivingly connected to the blade set, a housing assembly extending rearwardly from the blade set and including a main portion, and a removable portion located adjacent the blade set in enclosing relation to the blade drive assembly, and structure on the main portion and on the removable portion resiliently and removably connecting the removable portion to the main portion.

The invention also provides a hair clipper comprising a housing assembly having a forward end and including a main portion, and a removable portion located at the forward end, structure on the main portion and on the removable portion resiliently and removably connecting the removable portion to the main portion, a blade set pivotally mounted on the main portion of the housing assembly adjacent the forward end of the housing assembly for movement between an operating position and a retracted position pivotally spaced from the operating position, and a blade drive assembly drivingly connected to the blade set and located in rearward relation to the blade set and in position for access when the cover is removed from the housing assembly.

The invention also provides a hair clipper comprising a blade set, a blade drive assembly located rearwardly from the blade set and drivingly connected to the blade set, and a housing assembly extending rearwardly from the blade set and comprising an upper half-section fabricated of plastic material and including a lateral extending edge portion located in spaced relation to the blade set and having laterally spaced opposite ends, and a first recess located in rearwardly spaced relation from the laterally extending edge portion, and first and second laterally spaced guides extending forwardly from the laterally extending edge portion and in laterally outward relation to the first recess, a lower half-section fabricated of plastic material and including laterally spaced first and second edge segments respectively extending forwardly from the ends of the laterally extending edge portion and to adjacent the blade set, a second recess located in spaced relation from the first laterally spaced edge segment, and a third recess located in spaced relation from the second laterally spaced segment, and a removable cover portion which is resilient, which is fabricated of plastic material, which extends between the blade set and the laterally extending edge portion and between the first and second edge segments, which encloses the blade drive assembly, and which comprises an inner surface engaged by the first and second guides, a rearward edge located adjacent to the laterally extending edge portion of the upper half-section and including laterally spaced ends, first and second laterally spaced edges extending forwardly from the laterally spaced ends of the rearward edge, a forward edge located adjacent the blade set, a first detent extending from the first laterally spaced edge and including a first laterally outwardly extending lug releaseably engaged in the second recess, a second detent extending from the second laterally spaced edge and including a second laterally outwardly extending lug releaseably engaged in the third recess, a tab extending rearwardly from the rearward edge and releasably engaged in the first recess, and first and second ribs extending from the inner surface in respective laterally outwardly spaced relation from the tab and in adjacent laterally inward relation to the first and second guides.

Other features and advantages of the invention will become apparent to those skilled in the art upon review of the following detailed description, claims and drawings.

DESCRIPTION OF THE DRAWINGS

FIG. 1 is a perspective view of a hair clipper which embodies various of the features of the invention.

FIG. 2 is a partial top plan view of the hair clipper shown in FIG. 1.

FIG. 3 is a partially broken-away partial side view of the hair clipper shown in FIG. 1 and additionally illustrates, in dotted outline, a cover or cover portion which is removable.

FIG. 4 is also a partial side view of the hair clipper shown in FIG. 1, with portions broken away and in section.

FIG. 5 is a perspective view of the cover portion which is shown in full line and in dotted outline in FIG. 2, which view is particularly illustrative of the underside of the cover portion.

FIG. 6 is a fragmentary sectional view taken along line 6—6 of FIG. 2.

FIG. 7 is a fragmentary sectional view taken along line 7—7 of FIG. 2.

FIG. 8 is a fragmentary sectional view taken along line 8—8 of FIG. 2.

FIG. 9 is a fragmentary sectional view taken along line 9—9 of FIG. 2.

FIG. 10 is a fragmentary sectional view taken along line 10—10 of FIG. 2.

FIG. 11 is a fragmentary sectional view taken along line 11—11 of FIG. 2.

FIG. 12 is a fragmentary sectional view taken along line 12—12 of FIG. 2.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in FIG. 1 of the drawings is a hair clipper 11 comprising a cutting blade set 13, a blade drive assembly 15 (see FIG. 4) drivingly connected to the blade set 13, and an outer housing assembly 17 extending rearwardly from the blade set 13 and including a main portion 21, and a manually removable cover or cover portion 23 located adjacent the blade set 13 and in enclosing relation to the blade drive assembly 15. The main portion 21 of the outer housing assembly 17 and the cover portion 23 including resilient structure resiliently and removably connecting the cover portion 23 to the main portion 21, whereby removal of the removable cover portion 23 exposes the blade drive assembly 15.

More particularly, the main portion 21 of the outer housing assembly 17 includes a lower half-section 25 and an upper half-section 27 which is suitably connected to the lower half-section 25 in any suitable manner, such as by screws (not shown). The upper and lower half sections 25 and 27 are elongated and are generally semi-cylindrical in the direction transverse to the direction of elongation. The outer housing assembly 17 is preferably constructed of plastic, is relative rigid due to the configuration thereof, and is generally hollow.

The lower half-section 25 includes (see FIG. 1) an inner surface 31 and an outer surface 33, as well as forward and rearward ends 35 and 37 and laterally spaced edge portions 38 and 39 which extend around the periphery of the lower half-section 25. In addition, the upper half-section 27 includes an inner or inside surface 41 and an outer surface 43, as well as forward and rearward ends 45 and 47, and laterally spaced edge portions 48 and 49 which extend around the periphery of the upper half-section 27 and which mate with the laterally spaced edge portions 38 and 39 of the lower half-section 25. The laterally spaced edge portions 38 and 39 of the lower half-section 25 include respective forward end segments 51 and 53 which extend forwardly beyond the forward end 45 of the upper half-section 27.

The forward end 45 of the upper half-section 27 terminates, as already indicated, rearwardly of the forward end 35 of the lower half-section 25 and includes (see FIG. 4) a laterally extending forward edge portion 55 which extends between and joins the forward ends of the laterally spaced edge portions 48 and 49 of the upper half-section of the outer housing assembly 17. The forward termination of the upper half-section 27 rearwardly of the forward end 35 of the lower half-section 25 and rearwardly of the blade set 13 and the blade drive assembly 15 (still to be described in greater detail) provides (as will also be disclosed in greater detail hereinafter) access to the blade drive assembly 15 for cleaning, lubrication, and replacement thereof without requiring tools.

The blade set 13 (see FIG. 3) is preferably conventionally hingedly connected to the forward end 35 of the lower half-section 25 of the housing assembly 17 for movement between an operating position shown in full lines in FIGS. 3 and 4 and a pivotally spaced retracted position shown in dotted outline in FIG. 3. Any suitable mounting arrangement can be employed. In addition, the blade set 13 includes a stationary blade 61 and a moveable cutting blade 63 which laterally reciprocates relative to the stationary blade 61 to cut hair and which is driven by the drive assembly 15. Any conventional blade set which is compatible with the blade drive assembly 15 can be employed. In the particularly disclosed construction, the blade set is constructed as disclosed in U.S. Pat. No. 5,088,200 which is incorporated herein by reference.

The blade drive assembly 15 is fixedly supported within the hollow interior of the housing assembly 17 by a pair of screws (not shown), as disclosed in U.S. Pat. No. 5,088,200 which is incorporated herein by reference. The blade drive assembly 15 operatively extends between a drive motor 65 and the moveable cutting blade 63 to reciprocate the cutting blade 63 relative to the stationary blade 61 in response to energization of the drive motor 65.

The removable portion or cap or cover 23 extends forwardly from the laterally extending edge portion 55 of the upper half-section 27 and laterally between and from the forward end segments 51 and 53 of the laterally spaced edge portions 38 and 39 of the lower half-section 25 of the housing assembly 17. The removable portion or cap or cover 23 also extends rearwardly from adjacent the blade set 13 and in covering relation to the blade drive assembly 15. In this last regard, the cover or cover portion 23 includes (see FIG. 5) an inner surface 73 and an outer surface 75 which, when the cover 23 is assembled on the outer housing assembly 17, extends in smoothly merging relation to the outer surface of the outer housing assembly 17. In addition, the cover 23 includes a rearward edge 77 which is located adjacent to the laterally extending edge portion 55 of the upper half-section 27 and which includes laterally spaced ends 79 and 81, together with first and second laterally spaced edges 83 and 85 extending forwardly from the laterally spaced ends 79 and 81 of the rearward edge 77, and a forward edge 87 located adjacent the blade set 13. The outer surface 75 of the cover 23 also includes a generally flat surface portion 89 which extends rearward from the forward edge 87 and which is rearwardly convergent, as well as a pair of laterally spaced outer side surface portions 90 which merge smoothly with the outer surface 33 of the lower half-section 25 of the housing assembly 17.

The cover 23, and the upper and lower half-sections 25 and 27 of the outer housing assembly include structure which resiliently connects the cover 23 in removable assembled relation to the lower and upper half-sections 25 and 27 so that the outer surface 75 of the cover 23 blends smoothly with the outer surfaces 33 and 43 of the lower and upper half-sections 25 and 27 and so that the cover 23 can be removed from the housing assembly 17 to afford access to the blade drive assembly 15, without the use of tools, so as to facilitate lubrication, cleaning, or replacement of the blade drive assembly 15, as may be desired.

More particularly, and while other constructions can be employed, in the disclosed structure, such structure preferably comprises a first recess 91 located in the inner surface 31 of the lower half-section 25, in spaced relation below the forward edge segment 51 of the laterally spaced edge portion 38, and in spaced forward relation to the laterally extending edge portion 55 of the upper half-section 27, together with a second recess 93 located in the inner surface 31 of the lower half-section 25, in spaced relation below the forward edge segment 53 of the laterally spaced edge portion 39, and in spaced forward relation to the laterally extending edge portion 55 of the upper half-section 27.

In addition, such structure also includes, on the cover 23, a first resilient detent 95 extending downwardly or inwardly from the laterally spaced edge 83 and including a first laterally outwardly extending lug 97 which, when the cover 23 is connected to the outer housing assembly 17, is releaseably engaged in the first recess 91, and a second resilient detent 105 extending downwardly or inwardly from the laterally spaced edge 85 and including a second laterally outwardly extending lug 107 which, when the cover 23 is connected to the outer housing assembly 17, is releaseably engaged in the second recess 93.

Still further in addition, such structure includes (see FIGS. 4 and 5) a third recess 111 located in the inner or inside surface 41 of the upper half-section 27, in generally centered location relative to the laterally extending edge portion 55, and in rearwardly spaced relation from the laterally extending edge portion 55. In addition, the cover 23 also includes a tab 115 extending rearwardly from the rearward cover edge 77 and having, adjacent the rearward end thereof, an upwardly and inwardly extending lug 117 which, when the cover 23 is connected to the outer housing assembly 17, is releaseably engaged in the third recess 111.

Still further in addition, such structure includes (see FIG. 6), on the laterally spaced edges 83 and 85 of the cover 23, respective recesses 121 and 123 which respectively receive projections 127 and 129 respectively extending upwardly from the forward end segments 51 and 53 of the laterally spaced edge portions 38 and 39 of the lower half-section 25 of the housing assembly 17. Of course, the recesses 121 and 123 could be located in the laterally spaced edges 83 and 85 of the cover 23, and the projections 127 and 129 could extend from the forward end segments 51 and 53 of the laterally spaced edge portions 38 and 39 of the lower half-section 25 of the outer housing assembly 17.

In addition, such structure includes, on both the upper half-section 27 and the cover 23, laterally spaced guiding and supporting extensions or projections. More particularly, the upper half-section 27 includes (see FIG. 8) laterally spaced first and second extensions or projections 131 and 133 which extend forwardly beyond the laterally extending edge portion 55 and from the underside or inside surface 41 of the upper half-section 27, which extend in respective laterally adjacent relation to the rearwardly projecting tab 115 on the cover 23, and which extend into supporting engagement with the inside surface 73 of the cover 23. In addition, the cover 23 includes first and second laterally spaced inwardly extending ribs 137 and 139 which extend inwardly from the cover inside surface 73 in laterally outward adjacent relation to the first and second extensions or projections 131 and 133, thereby assisting in laterally locating the cover 23 in proper relation to the outer housing assembly 17.

The cover 23 is preferably fabricated of the same plastic as is employed in the lower and upper half-sections 25 and 27, except that the thickness of the cover 23, the relative short length of the cover 23, and the otherwise non semi-circular construction of the cover 23, at least as compared to the upper and lower half sections 25 and 27, is such that the cover 23 is resilient as compared to the lower and upper half-sections 25 and 27.

In use, when access to the blade drive assembly 15 is desired for cleaning, lubrication, or replacement, the cover 23 can be removed by the user by manually manipulating the cover or cover portion 23 to release the detentes 95 and 105 and to move the cover 23 upwardly and away from the lower half-section 25 and forwardly from the upper half-section 27 without the use of any tool. In this last regard, the hinged connection of the blade set 13 to the housing assembly 17 is particularly useful in connection with manual removal of the cover 23 from the housing assembly 17. More particularly, displacement of the blade set 13 to the retracted position shown in dotted lines in FIG. 3 enables improved grasp of the cover 23 and facilitates manual removal thereof from the housing assembly 17.

Various of the features are set forth in the following claims.

What is claimed is:

1. A hair clipper comprising a blade set, a blade drive assembly located rearwardly from said blade set and drivingly connected to said blade set, and a housing assembly extending rearwardly from said blade set and comprising an upper half-section fabricated of plastic material and including a laterally extending edge portion located in spaced relation to said blade set and having laterally spaced opposite ends, and a first recess located in rearwardly spaced relation from said laterally extending edge portion, and first and second laterally spaced guides extending forwardly from said laterally extending edge portion and in laterally outward relation to said first recess, a lower half-section fabricated of plastic material and including laterally spaced first and second edge segments respectively extending forwardly from said ends of said laterally extending edge portion and to adjacent said blade set, a second recess located in spaced relation from said first laterally spaced edge segment, and a third recess located in spaced relation from said second laterally spaced segment, and a removable cover portion which is resilient, which is fabricated of plastic material, which extends between said blade set and said laterally extending edge portion and between said first and second edge segments, which encloses said blade drive assembly, and which comprises an inner surface engaged by said first and second guides, a rearward edge located adjacent to said laterally extending edge portion of said upper half-section and including laterally spaced ends, first and second laterally spaced edges extending forwardly from said laterally spaced ends of said rearward edge, a forward edge located adjacent said blade set, a first detent extending from said first laterally spaced edge and including a first laterally outwardly extending lug releaseably engaged in said second recess, a second detent extending from said second laterally spaced edge and including a second laterally outwardly extending lug releaseably engaged in said third recess, a tab extending rearwardly from said rearward edge and releasably engaged in said first recess, and first and second ribs extending from said inner surface in respective laterally outwardly spaced relation from said tab and in adjacent laterally inward relation to said first and second guides.

2. A hair clipper in accordance with claim 1 wherein said upper and lower half-sections each includes an edge segment extending forwardly and rearwardly in adjacent relation to said blade drive assembly and including an outwardly projecting rib, and wherein said removable cover portion also includes, on each of said first and second laterally spaced edges, respective recesses respectively receiving said projecting ribs.

3. A hair clipper comprising a blade set, a blade drive assembly located in rearward relation to said blade set and drivingly connected to said blade set, and a housing assembly extending rearwardly from said blade set and including a main portion on which said blade set is mounted, and a removable concavely extending portion located adjacent said blade set and in overlying enclosing relation to said blade drive assembly and in unconnected relation to said blade set so as to afford removal of said removable portion without affecting the mounting of said blade set on said main portion, and resiliently deformable structure located on one of said main portion and said removable portion and enabling resilient and removable connection of said removable portion to said main portion.

4. A hair clipper in accordance with claim 3 wherein said removable portion is resiliently flexible.

5. A hair clipper in accordance with claim 3 wherein said removable portion includes a rearward edge located adjacent to said main portion and including laterally spaced ends, first and second laterally spaced edges extending forwardly from said laterally spaced ends of said rearward edge, and a forward edge located adjacent said blade drive assembly.

6. A hair clipper in accordance with claim 3 wherein said main portion includes a laterally extending edge portion located in rearwardly spaced relation from said blade set, wherein said structure includes, on said main portion, a recess located rearwardly from said laterally extending edge portion, and wherein said structure includes, on said removable portion, a tab extending into said recess.

7. A hair clipper in accordance with claim 3 wherein said removable portion is resilient and is fabricated of plastic material.

8. A hair clipper in accordance with claim 3 wherein said housing assembly includes first and second sections in mating engagement.

9. A hair clipper comprising a blade set, a blade drive assembly located in rearward relation to said blade set and drivingly connected to said blade set, a housing assembly extending rearwardly from said blade set and including a main portion, and a removable portion located adjacent said blade set in enclosing relation to said blade drive assembly and including a rearward edge located adjacent to said main portion and including laterally spaced ends, first and second laterally spaced edges extending forwardly from said laterally spaced ends of said rearward edge, and a forward edge located adjacent said blade drive assembly, and structure on said main portion and on said removable portion resiliently and removably connecting said removable portion to said main portion, said structure on said main portion and on said removable portion including a first resilient detent extending from said first laterally spaced edge of said removable portion and releaseably engaging said main portion, and a second resilient detent extending from said second laterally spaced edge of said removable portion and releaseably engaging said main portion.

10. A hair clipper comprising a blade set, a blade drive assembly located in rearward relation to said blade set and drivingly connected to said blade set, a housing assembly extending rearwardly from said blade set and including a main portion having a laterally extending edge portion located in spaced relation to said blade set and having laterally spaced ends, said laterally extending edge portion having laterally spaced first and second edge segments respectively extending forwardly from said laterally spaced ends of said laterally extending edge portion and to adjacent said blade set, and a removable portion located adjacent said blade set in enclosing relation to said blade drive assembly, said removable portion including a rearward edge located adjacent to said laterally extending edge portion of said main portion, said rearward edge including laterally spaced ends, first and second laterally spaced edges extending forwardly from said laterally spaced ends of said rearward edge and in respective adjacent relation to said laterally spaced first and second edge segments of said main portion, and a forward edge located adjacent said blade set, and structure located on said main portion and on said removable portion, resiliently and removably connecting said removable portion to said main portion, said structure including a first recess located in said main portion in adjacently spaced relation to said first edge segment, a second recess located in said main portion in adjacently spaced relation to said second edge segment, a first resilient detent extending from said first laterally spaced edge of said removable portion and releaseably engaged in said first recess, and a second resilient detent extending from said second laterally spaced edge of said removable portion and releaseably engaged in said second recess.

11. A hair clipper in accordance with claim 10 wherein said first detent includes a first laterally outwardly extending lug received in said first recess, and wherein said second detent includes a second laterally outwardly extending lug received in said second recess.

12. A hair clipper comprising a blade set, a blade drive assembly located in rearward relation to said blade set and drivingly connected to said blade set, and a housing assembly extending rearwardly from said blade set and including a main portion including a laterally extending edge portion located in rearwardly spaced relation from said blade set, and first and second laterally spaced guides extending forwardly from said laterally extending edge portion, a removable portion located adjacent said blade set in enclosing relation to said blade drive assembly, and structure on said main portion and on said removable portion resiliently and removably connecting said removable portion to said main portion, said structure including, on said main portion, a recess located rearwardly from said laterally extending edge portion and laterally inwardly of said first and second laterally spaced guides, and said structure including, on said removable portion, a tab extending into said recess.

13. A hair clipper in accordance with claim 12 wherein said removable portion includes an inner surface engaged by said first and second guides, and first and second ribs respectively extending from said inner surface in spaced and laterally outward relation from said tab and in adjacent laterally outward relation to said first and second guides.

14. A hair clipper comprising a blade set, a blade drive assembly located in rearward relation to said blade set and drivingly connected to said blade set, and a housing assembly extending rearwardly from said blade set and including a main portion including an edge segment extending forwardly and rearwardly in adjacent relation to said blade drive assembly, a removable portion located adjacent said blade set in enclosing relation to said blade drive assembly, and structure on said main portion and on said removable portion resiliently and removably connecting said removable portion to said main portion, said structure including, on one of said removable portion and said edge segment, a rib, and said structure also including, on the other of said removable portion and said edge segment, a recess receiving said rib.

15. A hair clipper comprising a housing assembly including a first section including a forward edge having laterally spaced ends, and a second section in mating engagement with said first section and including laterally spaced side edges extending forwardly from said ends of said forward edge, a removable portion located at said forward edge and including a rearward edge having laterally spaced ends and extending in mating engagement with said forward edge of said first section, and spaced side edges extending forwardly from said ends of said rearward edge and in mating engagement with said side edges of said second section, a blade set pivotally mounted on said housing assembly adjacent said forward edge of said first section and in underlying relation to said removable portion and free of said removable portion for movement between an operating position and a retracted position pivotally spaced from said operating position, resiliently deformable structure located on one of said housing assembly and said removable portion and enabling resilient and removable connection of said removable portion to said housing assembly so as to afford removal of said removable portion without affecting the mounting of said blade set on said housing assembly, and a blade drive assembly drivingly connected to said blade set and located in rearward relation to said blade set and in position for access when said removable portion is removed from said housing assembly.

16. A hair clipper in accordance with claim 15 wherein said removable portion is located in overlying relation to said blade drive assembly and is concavely shaped in relation to said blade set.

17. A hair clipper comprising a blade set, a blade drive assembly located in rearward relation to said blade set and drivingly connected to said blade set, and a housing assembly extending rearwardly from said blade set and including first and second sections in mating engagement, one of said first and second sections including an arcuate forward edge having laterally spaced ends, the other of said first and second sections including laterally spaced side edges extending forwardly from said ends of said forward edge, and a main portion on which said blade set is mounted, and a removable concavely extending portion located adjacent said blade set and in overlying enclosing relation to said blade drive assembly and in unconnected relation to said blade set so as to afford removal of said removable portion without affecting the mounting of said blade set on said main portion, said removable portion including an arcuate rearward edge in mating engagement with said forward edge of said one of said first and second sections and having laterally spaced ends, and spaced side edges extending forwardly from said ends of said rearward edge and in mating engagement with said side edges of said other of said first and second sections, and resiliently deformable structure located on one of said main portion and said removable portion and enabling resilient and removable connection of said removable portion to said main portion.

18. A hair clipper comprising a blade set, a blade drive assembly located in rearward relation to said blade set and drivingly connected to said blade set, and a housing assembly extending rearwardly from said blade set and including a main portion on which said blade set is mounted and including a removable concavely extending portion located adjacent said blade set and in overlying enclosing relation to said blade drive assembly and in unconnected relation to said blade set so as to afford removal of said removable portion without affecting the mounting of said blade set on said main portion, said removable portion including an arcuate forward edge having laterally spaced ends, laterally spaced side edges extending forwardly from said ends of said forward edge, and an arcuate rearward edge in mating engagement with said forward edge of said main portion and having laterally spaced ends, and said spaced side edges extending forwardly from said ends of said rearward edge and in mating engagement with said side edges of said main portion, and resiliently deformable structure located on one of said main portion and said removable portion and enabling resilient and removable connection of said removable portion to said main portion.

* * * * *